US011280567B1

(12) United States Patent
Hart

(10) Patent No.: US 11,280,567 B1
(45) Date of Patent: Mar. 22, 2022

(54) ADJUSTABLE GAS PISTON ACTION FIREARM

(71) Applicant: Heckler & Koch Inc., Columbus, GA (US)

(72) Inventor: Riley Hart, Columbus, GA (US)

(73) Assignee: Heckler & Koch Inc., Columbus, GA (US)

( * ) Notice: Subject to any disclaimer, the term of this patent is extended or adjusted under 35 U.S.C. 154(b) by 0 days.

(21) Appl. No.: 16/951,040

(22) Filed: Nov. 18, 2020

Related U.S. Application Data

(60) Provisional application No. 62/939,894, filed on Nov. 25, 2019.

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/26; F41A 5/28
See application file for complete search history.

(56) References Cited

U.S. PATENT DOCUMENTS

| | | | | |
|---|---|---|---|---|
| 2,409,225 | A * | 10/1946 | Schaich | F41A 5/26 89/193 |
| 3,842,527 | A | 10/1974 | Low | |
| 5,824,943 | A | 10/1998 | Guhring et al. | |
| 6,619,592 | B2 | 9/2003 | Vignaroli et al. | |
| 7,621,210 | B2 | 11/2009 | Fluhr et al. | |
| 7,739,939 | B2 | 6/2010 | Adams | |
| 7,827,722 | B1 | 11/2010 | Davies | |
| 7,971,518 | B2 | 7/2011 | Adams | |
| 8,359,966 | B1 | 1/2013 | Brotherton | |
| 8,528,458 | B2 | 9/2013 | Windauer | |
| 8,869,674 | B2 | 10/2014 | Ruck et al. | |
| 8,893,608 | B2 | 11/2014 | Kramer | |
| 9,032,860 | B2 | 5/2015 | Faxon | |
| 9,228,786 | B2 | 1/2016 | Sullivan et al. | |
| 9,541,340 | B2 | 1/2017 | Fluhr et al. | |
| 9,810,493 | B2 | 11/2017 | Fluhr et al. | |
| 9,816,769 | B1 | 11/2017 | Brown | |
| 2002/0073832 | A1 | 6/2002 | Vignaroli et al. | |
| 2009/0229454 | A1 | 9/2009 | Fluhr et al. | |
| 2011/0185886 | A1* | 8/2011 | Boutin, Jr. | F41A 5/24 89/179 |
| 2014/0224114 | A1* | 8/2014 | Faxon | F41A 3/66 89/193 |

(Continued)

FOREIGN PATENT DOCUMENTS

| | | | | |
|---|---|---|---|---|
| EP | 0055691 | A1 * | 7/1982 | F41A 5/26 |

*Primary Examiner* — Gabriel J. Klein
(74) *Attorney, Agent, or Firm* — Wood Herron & Evans LLP

(57) ABSTRACT

Provided is an external piston gas-operated firearm with an adjustable gas flow. A gas piston is operably connected to a bolt carrier. A gas block has an internal cylinder configured to receive a head portion of the gas piston and the cylinder is operably connected to a barrel bore to allow propellant gas pressure to bear against a face of the piston head portion. The gas piston includes at least one axially selectively positionable exhaust port such that in a first axial orientation no gas is vented through the exhaust port and in a second axial orientation a portion of the gas pressure is exhausted in conjunction with displacement of the piston to cycle the action.

17 Claims, 11 Drawing Sheets

(56) References Cited

U.S. PATENT DOCUMENTS

| | | | | |
|---|---|---|---|---|
| 2016/0069628 | A1 | 3/2016 | Fluhr et al. | |
| 2018/0156553 | A1* | 6/2018 | Rode | F41A 5/28 |
| 2020/0240734 | A1* | 7/2020 | Serbu | F41A 3/26 |

* cited by examiner

ADJUSTABLE GAS PISTON ACTION FIREARM

CROSS-REFERENCE TO RELATED APPLICATION

This application is a U.S. Non-Provisional Patent application claiming priority to U.S. Provisional Patent Application No. 62/939,894, filed on Nov. 25, 2019, the disclosure of which is hereby incorporated by reference herein in its entirety.

TECHNICAL FIELD

This invention relates to firearms, particularly to gas-operated auto-loading firearms.

BACKGROUND

Gas piston operated firearms are typically designed to port a predetermined flow of propulsion gas from the barrel bore to cycle the action, either with an internal or external gas piston system. When a noise suppressor is mounted to the muzzle, an increase in back pressure and corresponding increase in gas pressure ported into the gas block often results. In such gas piston systems, including long-stroke external piston systems, this over-pressure can cause the action to cycle too fast or cause damage to parts of the system.

Gas blocks have been adapted with various valving mechanisms to control the flow of gas pressure that reaches the piston head. Some of these require tools to adjust and some are marked with only a number or letter, allowing the user to forget which setting is for suppressed or unsuppressed fire.

SUMMARY OF THE INVENTION

The present invention provides a gas piston firearm action that is adjustable for use with or without a noise suppressor that causes increased back-pressure. The piston head has at least one port that may be axially selectively oriented to be blocked or to vent a portion of the operating gas pressure.

The vented gas may be exhausted out the front of the gas block so that excess heat is not accumulated inside the handguard.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
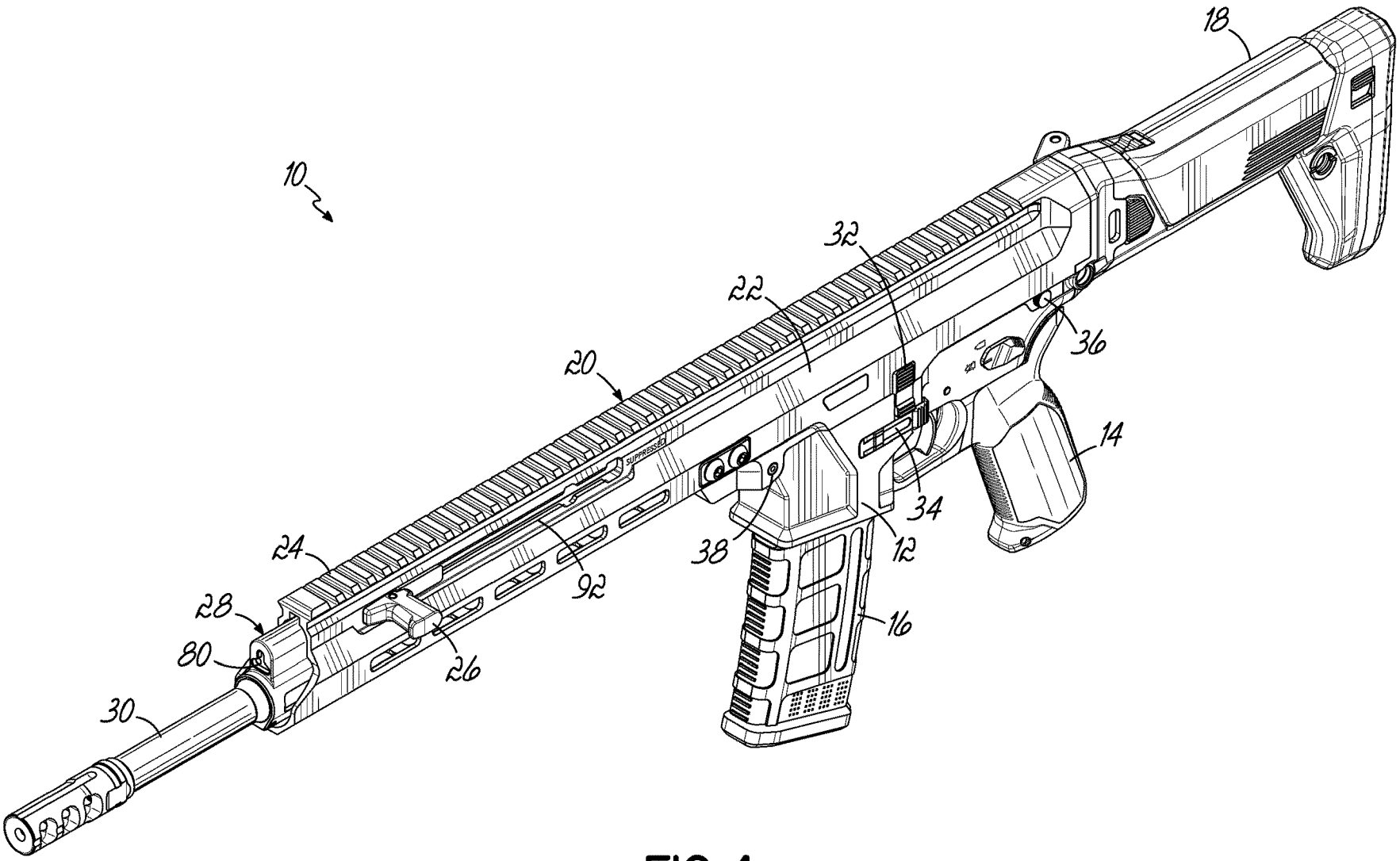
FIG. 1 is a first isometric view of a firearm according to an embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

As used herein, "forward" will indicate the direction of the muzzle and the direction in which projectiles are fired, while "rearward" will indicate the opposite direction. "Lateral" or "transverse" indicates a side-to-side direction generally perpendicular to the "axial" direction of the barrel of the barrel. Although firearms may be used in any orientation, "left" and "right" will generally indicate the sides according to the user's orientation, "top" or "up" will be the upward direction when the firearm is gripped in the ordinary manner. "Automatic" refers to an auto-loading operating system to cycle the action, whether in semiautomatic or fully automatic mode.

Figure 2:
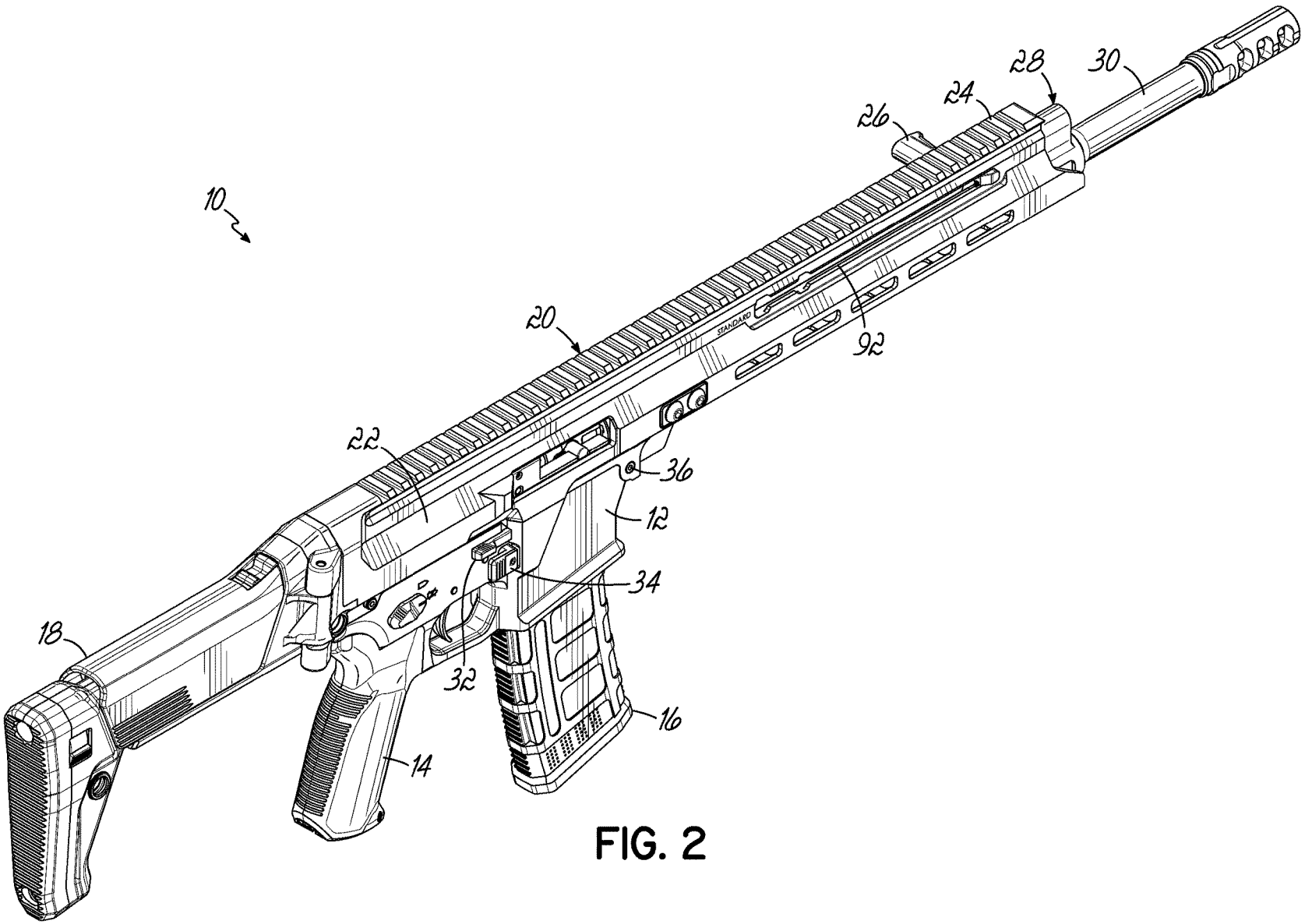
FIG. 2 is an alternate isometric view thereof.

Referring first to FIGS. 1 and 2, therein is shown a rifle 10 according to one embodiment of the present invention. In general, the rifle 10 includes a fire control housing 12 having a pistol grip 14 and detachable ammunition magazine 16. A butt stock 18 may be adjustable and foldable to one side. The upper receiver assembly 20 may include (as shown) a unitary upper receiver portion 22 and forearm portion 24 with a side-reversible charging handle 26 in the forearm portion 24. A gas block 28 is mounted on the barrel 30 to divert a portion of gas pressure to cycle the action when each round is fired. The ergonomics of the fire control housing 12 can match those of an AR-pattern lower receiver for familiarity, if desired. The rifle 10 user may use the same ammunition magazines 16, grip 14, and fire control parts (not shown) as an AR-pattern firearm. Additionally, the location geometry for the bolt release 32 (ambidextrous) and magazine release 34 may match that of an AR-pattern firearm. The upper receiver assembly 20 is inseparably attached to the fire control housing 12 using captured takedown pins 36, 38 that pass through lugs 40, 42 of the lower receiver 12.

Figure 3:
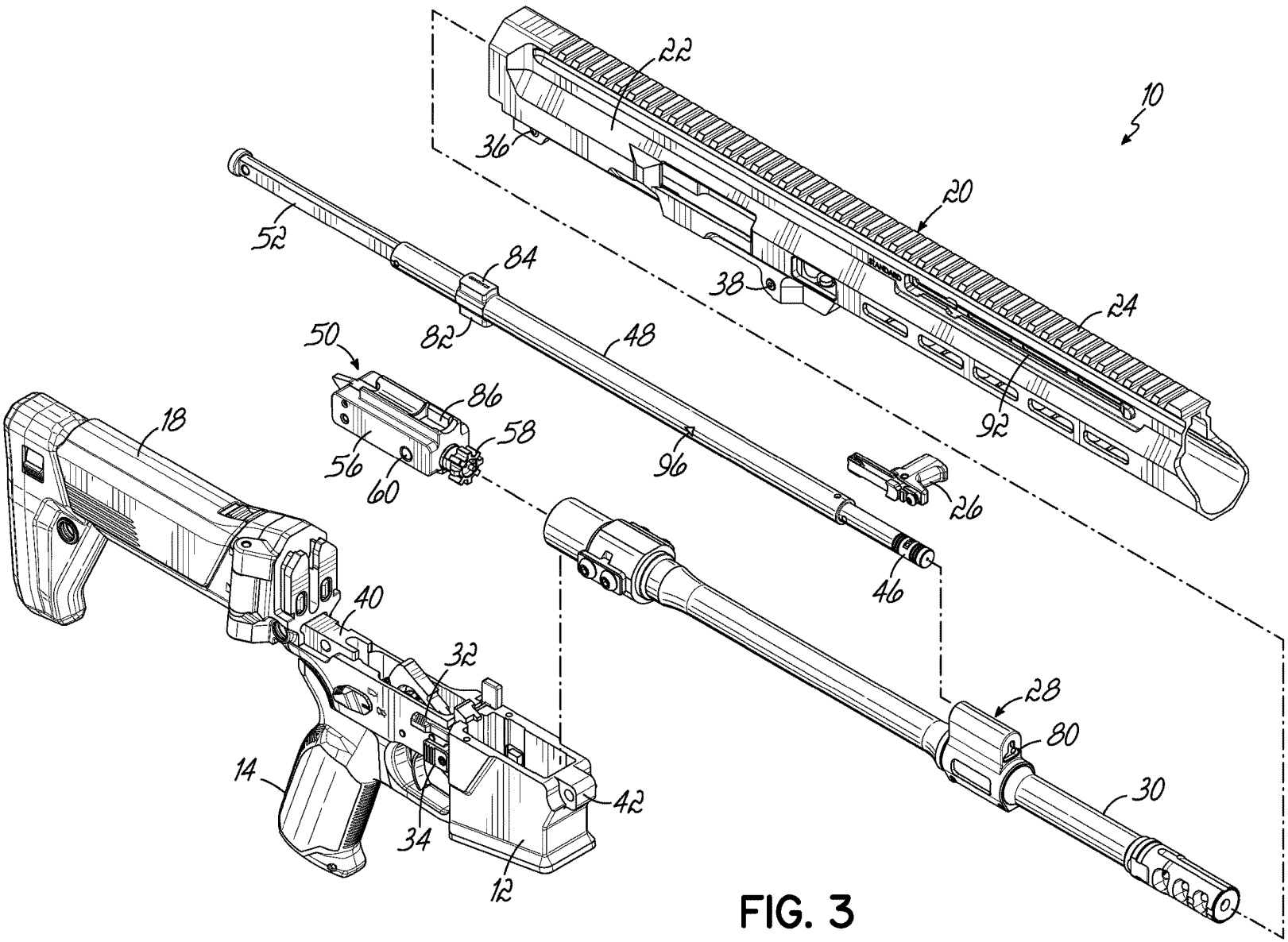
FIG. 3 is an exploded isometric view thereof.
Figure 4:
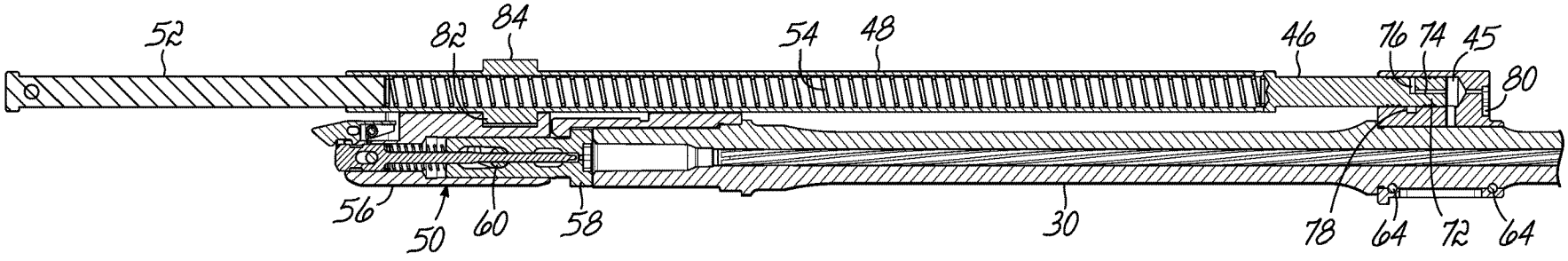
FIG. 4 is a side longitudinal sectional view of the long-stroke gas piston system.

Referring now also to FIGS. 3 and 4, the illustrated rifle 10 uses a long-stroke gas piston action. The operating system includes the gas block 28 that houses a cylinder chamber 45 that receives a piston 46. The piston 46 is connected to an operating rod 48, which separably engages the bolt carrier assembly 50. The piston 46 and operating rod may be unitary or separate parts operably connected together. The operating rod 48 may be hollow and engage a guide rod 52 at its rearward end and can house a recoil spring 54 inside.

Figure 5:
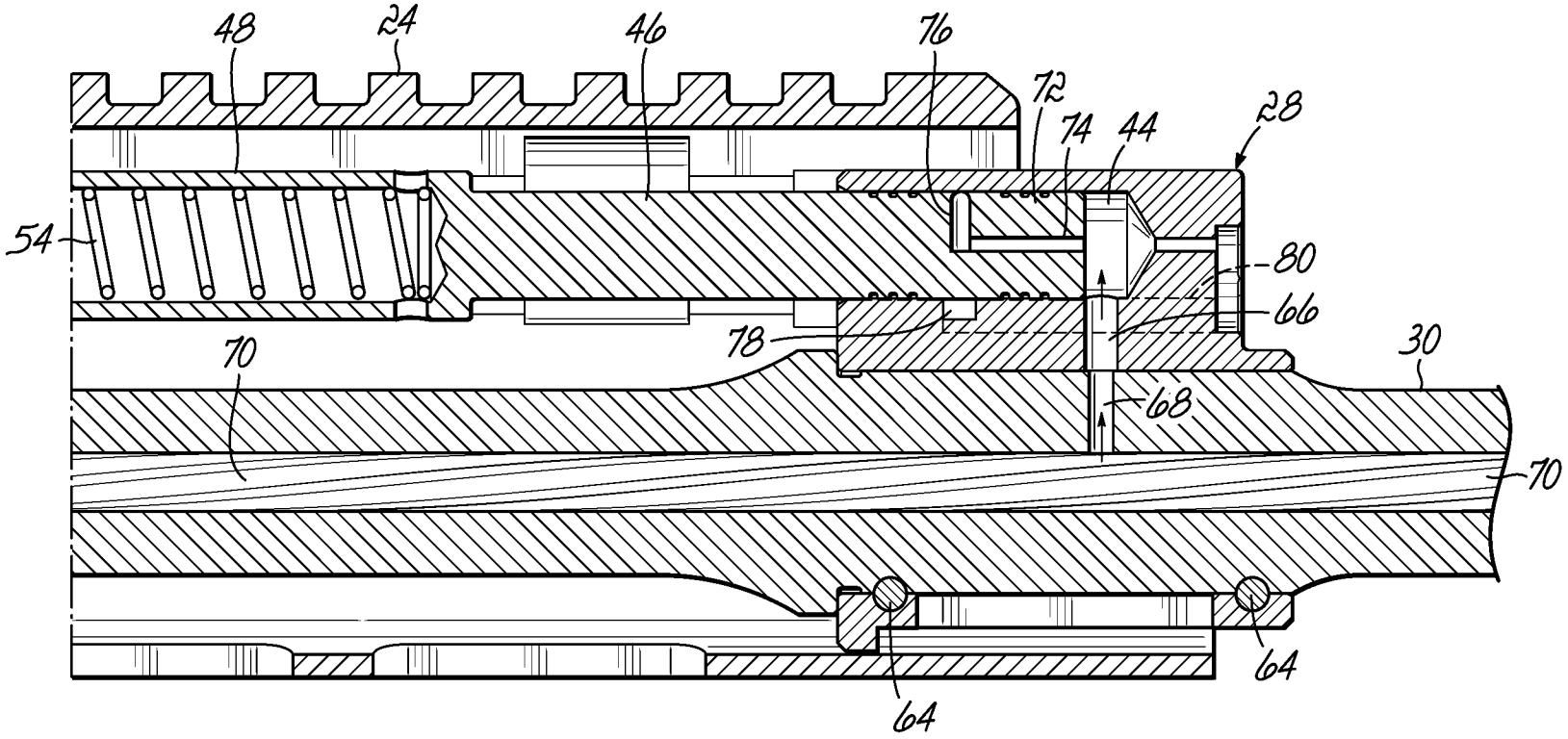
FIG. 5 is an enlarged side sectional view of a gas block and piston according to one embodiment of the invention in a first configuration for unsuppressed fire.
Figure 7:
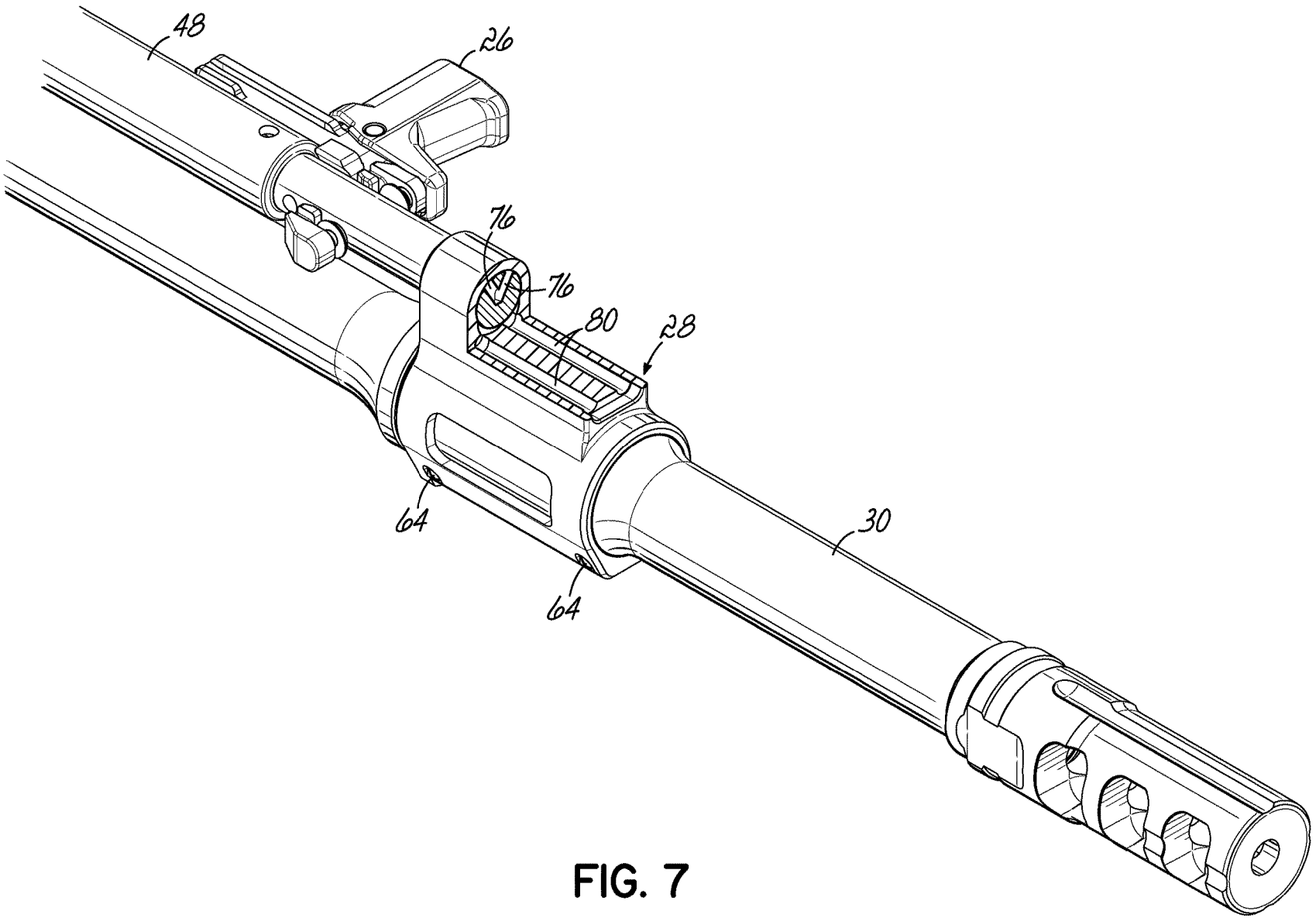
FIG. 7 is a cut-way view of the gas block and piston in a first orientation.

Referring now to FIGS. 5 and 7, therein is shown a feature of one embodiment of the present invention that allows the long-stroke piston unit to be reoriented depending on whether the firearm 10 is being used with or without a noise suppressor (not shown). The gas block 28 is mounted to the barrel 30, such as by transverse pins 64, 66 so that a gas passageway 66 is aligned with a gas port 68 in the barrel 30. The gas port 68 and passageway 66 allow pressurized propulsion gases from the barrel bore 70 to flow into the cylinder chamber 44 of the gas block 28 after the projectile passes. The head portion 72 of the piston 46 may be selectively vented, such as including a longitudinal central bore or passageway 74, extending from the face of the head portion 72 a predetermined axial distance, at which it branches into one or more radial exhaust ports 76. As shown in FIGS. 5 and 7, in a first orientation of the piston 46, the radial exhaust ports 76 terminate against and are blocked by an inner wall of the cylinder chamber 44. In this orientation, the longitudinal central bore/passageway 74 and radial exhaust ports 76 are inconsequential to operation of the system. In this configuration, the gas system would operate in a "STANDARD" or unsuppressed mode.

Figure 6:
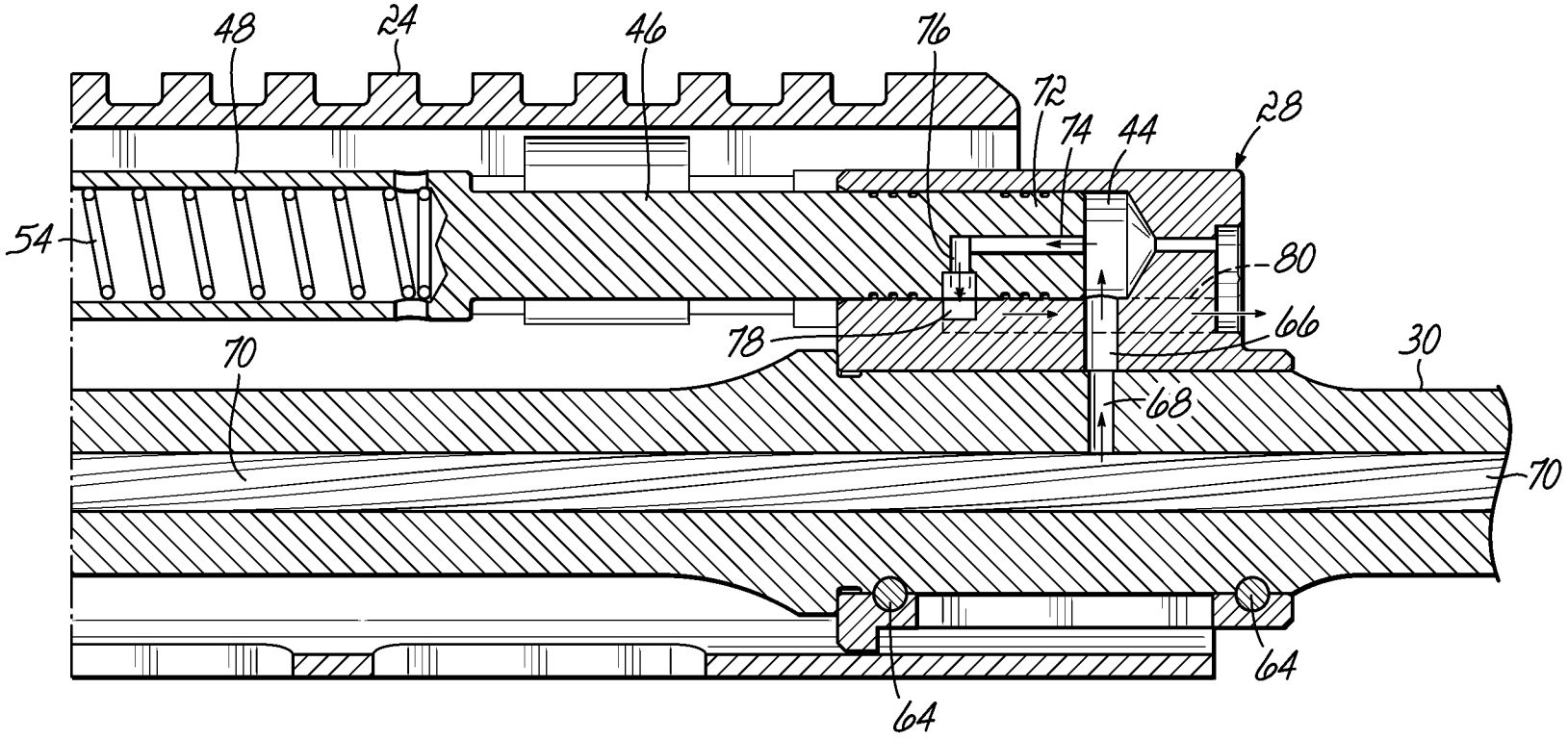
FIG. 6 is a similar view showing the piston in a second orientation.
Figure 8:
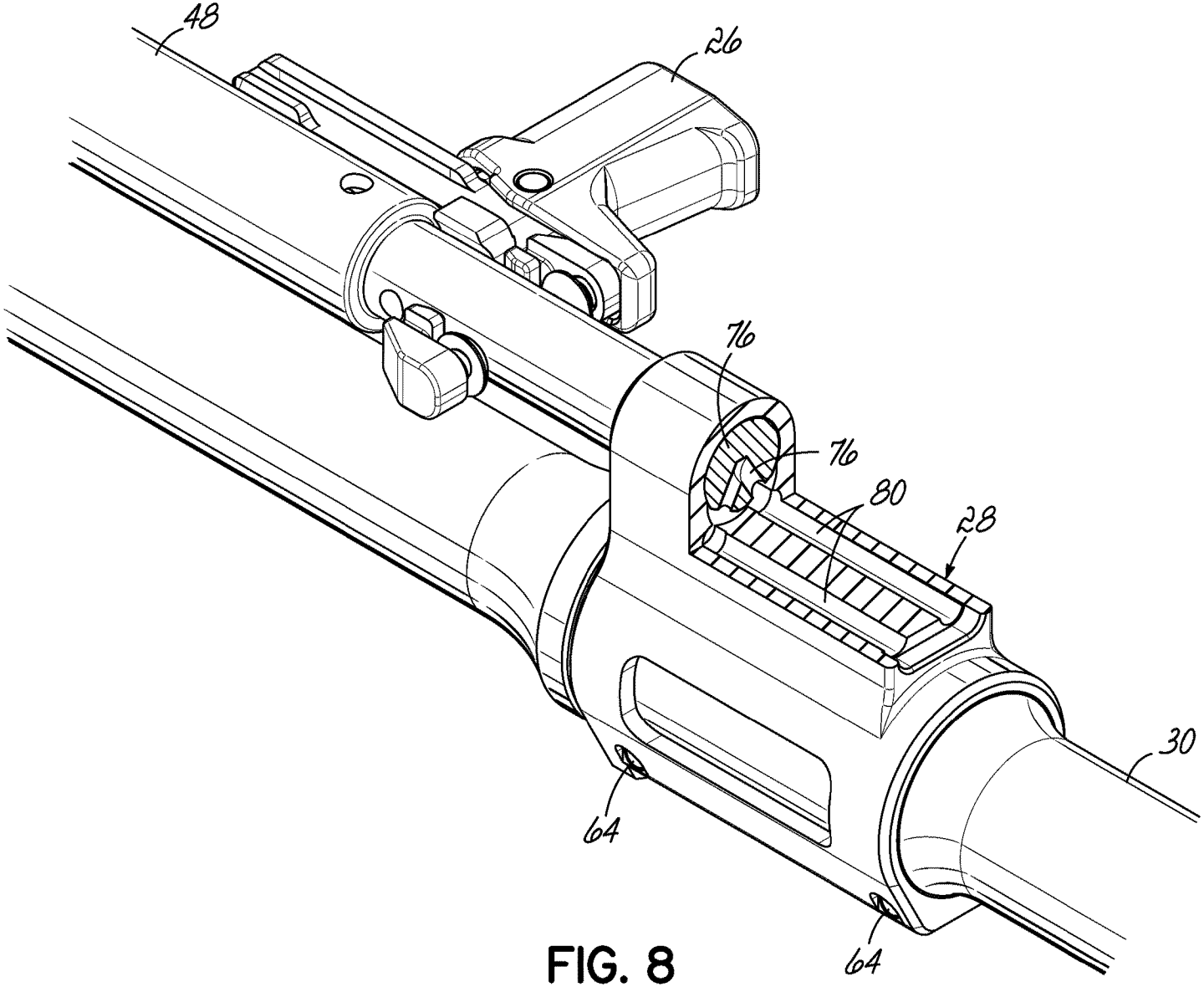
FIG. 8 is a similar view showing the piston in a second orientation.

Referring now to FIGS. 6 and 8, when the piston 46 is rotated along its longitudinal central axis 180°, the radial exhaust ports 76 are in fluid communication with a collection chamber 78 which, in turn, is connected to a pair of laterally spaced-apart forward exhaust passageways 80. In this orientation, a portion of the propellant gas ported to the gas block chamber 44 is able to vent through the longitudinal central bore/passageway 74 and radial exhaust ports 76 in the head portion 72 of the piston 46. This redirected gas pressure then flows into the collection chamber and exhausts to the atmosphere through the forward exhaust passageways 80. Accordingly, the gas pressure bearing on the face of the piston head 72 is reduced. This allows smooth and efficient operation of the gas system when a noise suppressor (not shown) is attached to the muzzle of the barrel 30. Venting hot gases forwardly through the front of the gas block 28 prevents excess heat build-up or entrapment under the handguard or forearm 24.

Figure 9:
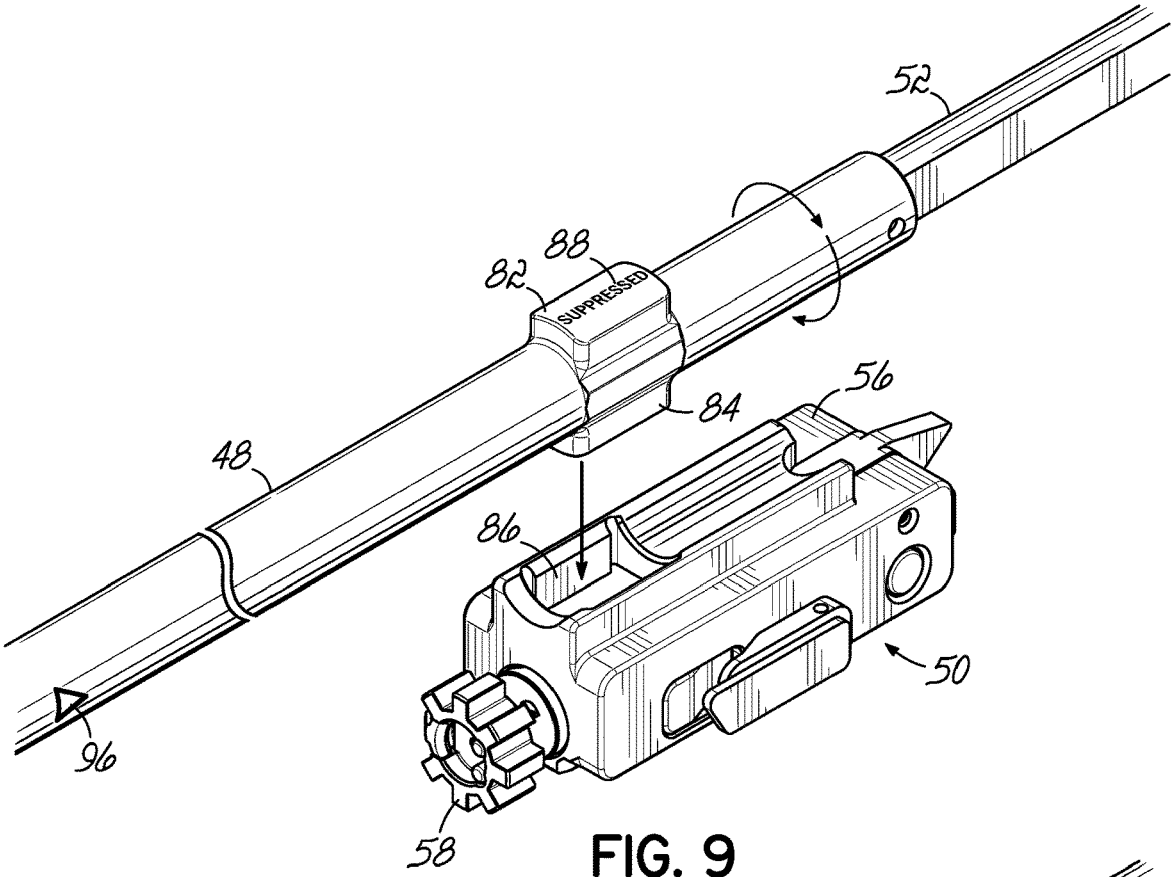
FIG. 9 is an exploded isometric view showing the disassembled connection between the bolt carrier assembly and operating rod in a first orientation.
Figure 10:
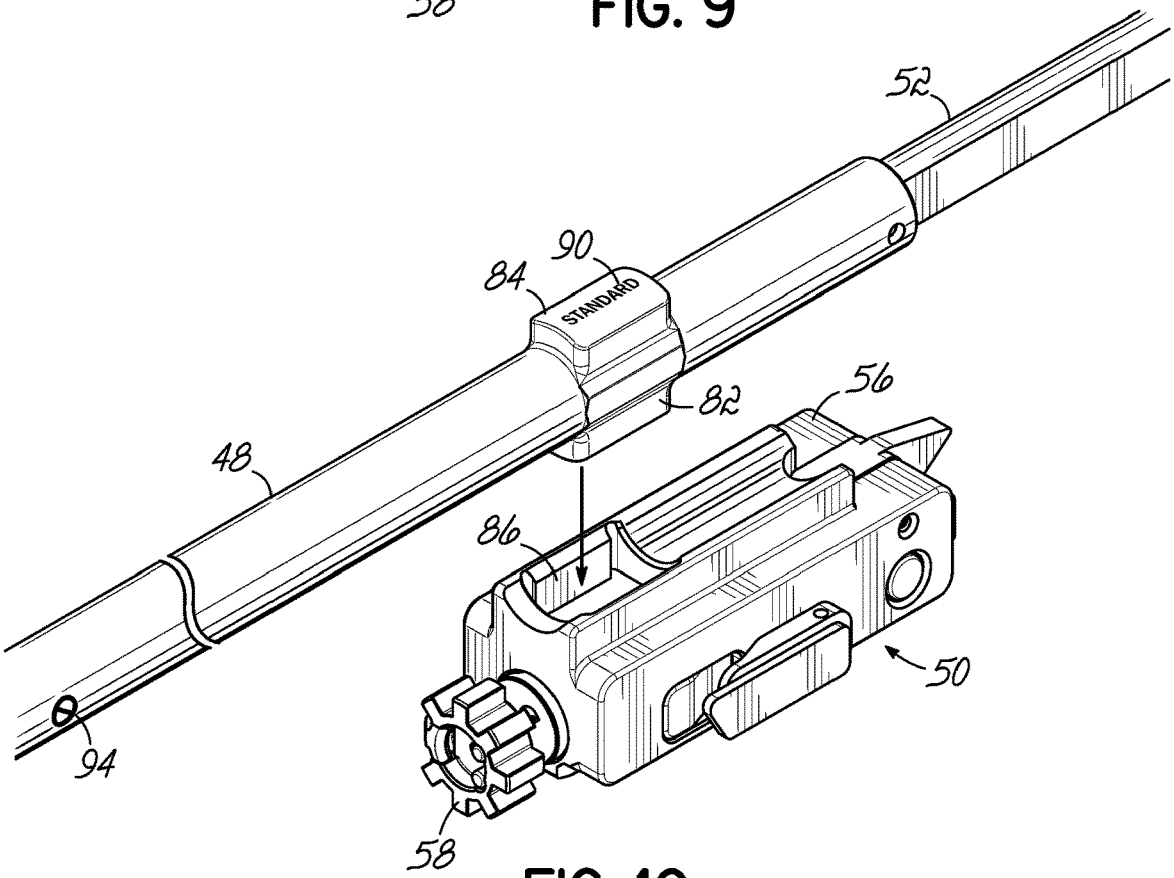
FIG. 10 is a similar view showing the operating rod in a second orientation.

Orientation of the piston 46 (and, thus, the radial exhaust ports 76) is accomplished by separating the upper receiver assembly 20 from the fire control housing 12 and removing the bolt carrier assembly 50 and recoil unit (piston 46, operating rod 48, guide rod 52, and recoil spring 54) from the rear of the upper receiver portion 22. Once removed, the operating rod 48 and recoil assembly is easily separated from the bolt carrier assembly, as shown in FIGS. 9 and 10.

Referring again also to FIGS. 7-10, the operating rod 48 may be provided with diametrically opposed lugs 82, 84 that fit into a socket 86 in the body 56 of the bolt carrier assembly 50. The fit of either lug 82, 84 provides sheer engagement in a longitudinal direction, while allowing easy disengagement when removed from the upper receiver assembly 20. The lugs 82, 84 or an adjacent area may be provided with indicia 88, 90 indicating whether the piston/operating rod assembly 46, 48 is oriented for "SUPPRESSED" or "STANDARD" (unsuppressed) use. When oriented in the "STANDARD" orientation, the radial exhaust ports 76 are oriented to be blocked by an interior wall of the cylinder chamber 44 in the gas block 28 (FIG. 7). When in the "SUPPRESSED" orientation, the radial exhaust ports 76 are oriented to communicate with the collection chamber 78 and forward exhaust passageways 80 (FIG. 8).

According to a feature of another embodiment of the invention, an external indicator of the piston orientation may be provided. Referring now also to FIGS. 11-14, the forearm portion 24 is provided with left and right longitudinal slots 92 to allow longitudinal movement of the charging handle 26 on either side. The longitudinal slots 92 allow the operating rod 48 to be seen from either side. The operating rod 48 may be provided with a symbol 94, 96 that corresponds to indicia 98, 100 to indicate whether the piston 46 is oriented to the "SUPPRESSED" or "STANDARD" position.

Figure 11:
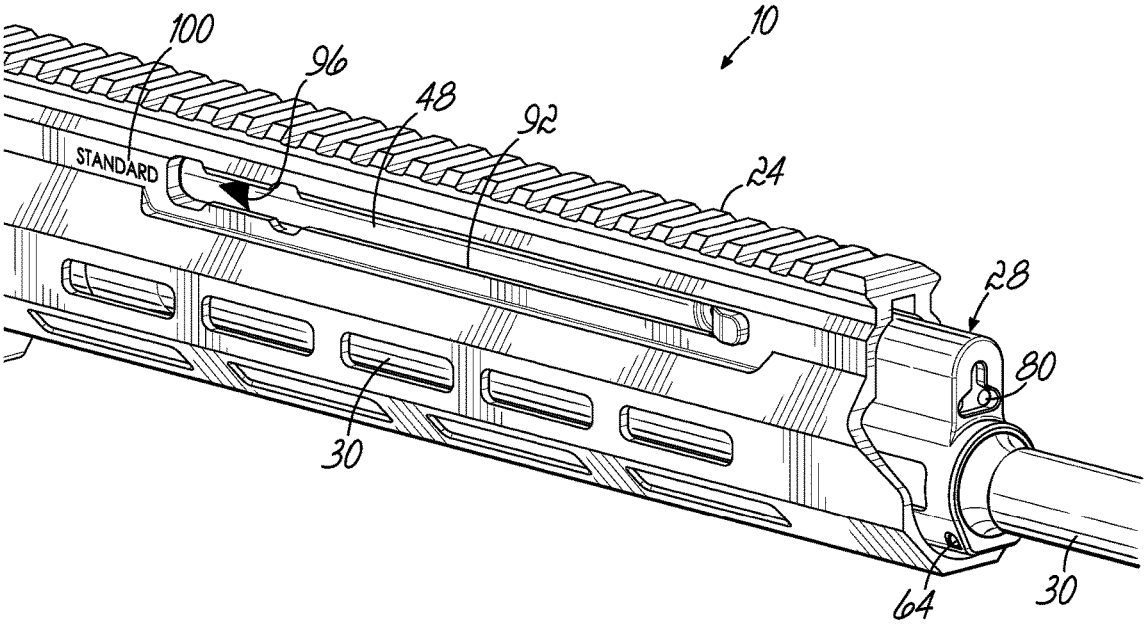
FIGS. 11 and 12 are right and left side isometric views, respectively, of a forearm portion showing indicia on the operating rod in a first orientation.
Figure 12:
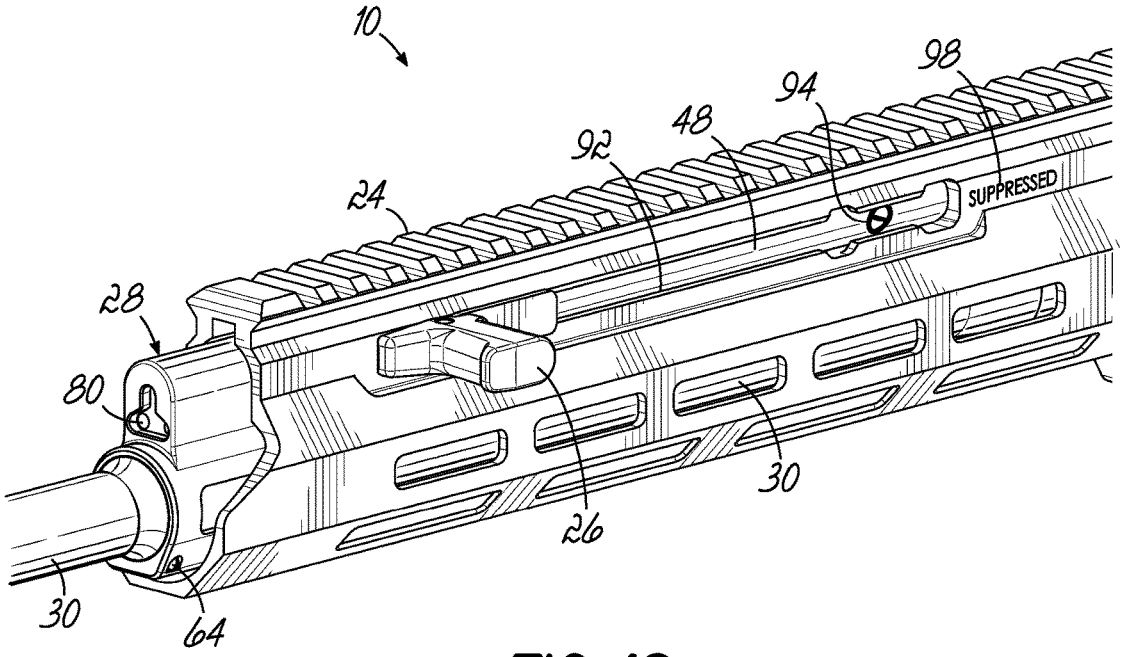

In FIGS. 11 and 12, the operating rod 48 and piston 46 (not shown) is in the "STANDARD" orientation, meaning it is intended for use without a noise suppressor attached. In this orientation, a first symbol 96, which can be an arrow, star, or other positive indicator, is associated with the indicia 100 "STANDARD" on the right side of the forearm portion 27, corresponding with where the symbol 96 can be viewed through the longitudinal slot 92 (FIG. 11). On the left side of the forearm 24 a symbol 94 can be viewed through the longitudinal slot and corresponds with indicia 98 "SUPPRESSED" (FIG. 12). This symbol 94 may be a negative symbol, such as the universal prohibition symbol, a stop sign, or an "X" to indicate that the orientation is not that indicated by the indicia 98 on that side.

Figure 13:
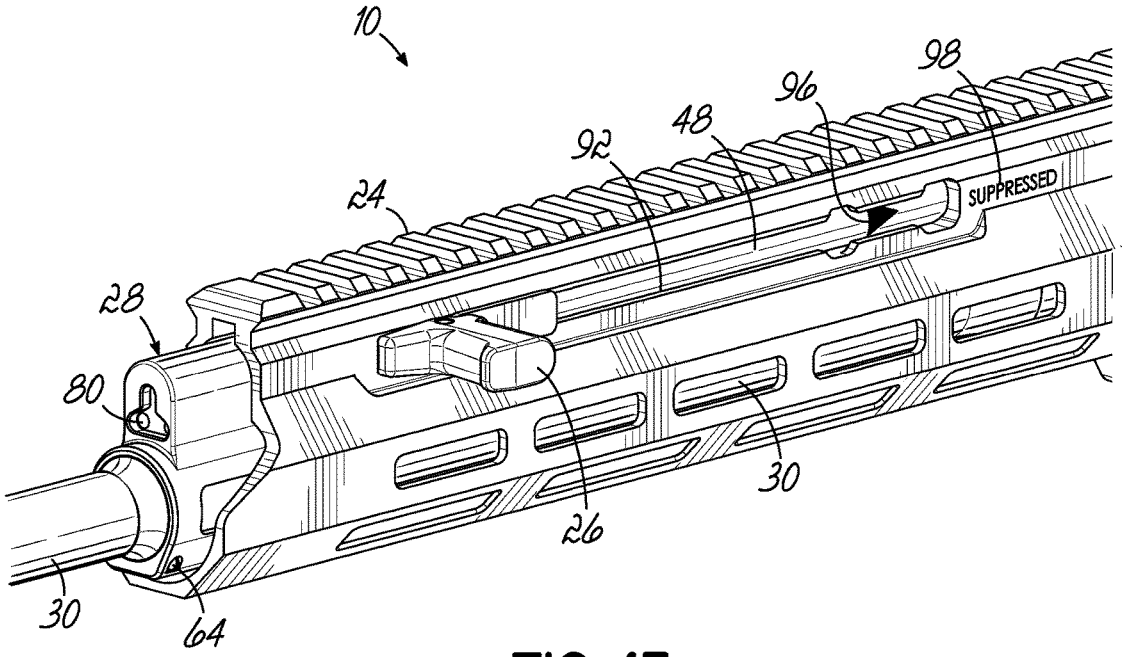
FIGS. 13 and 14 are left and right side isometric views, respectively, of the forearm portion showing the operating rod in a second orientation.
Figure 14:
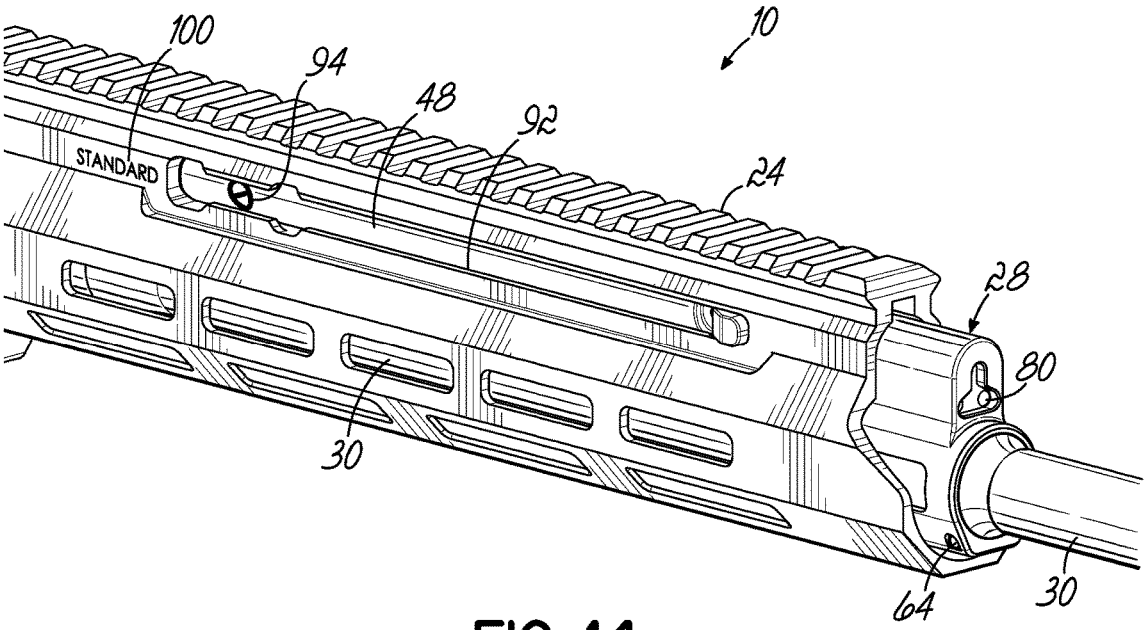

Likewise, referring now to FIGS. 13 and 14, when the operating rod 48 and piston 46 (not shown) is oriented to exhaust excess pressure in the cylinder chamber 44 of the gas block 28, the positive symbol 96 is viewable through the longitudinal slot 92 in association with the indicia 98 indicating "SUPPRESSED." On the opposite side, the negative symbol 94 may be viewed in association with indicia 100 "standard". As seen, in either orientation, physical confirmation is shown on either/both sides of the forearm 24.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. An external piston gas-operated firearm with adjustable gas flow, comprising:

a gas piston operably connected to a bolt carrier;

a gas block having an internal cylinder configured to receive a head portion of the gas piston, the cylinder operably connected to a barrel bore to allow propellant gas pressure to bear against a face of the piston head portion; and wherein the gas piston includes at least one axially selectively positionable exhaust port such that in a first axial orientation no gas is vented through the exhaust port, and in a second axial orientation a portion of the gas is vented through the exhaust port in conjunction with displacement of the piston to cycle the action, wherein the vented gas is directed forwardly toward a muzzle of the firearm.

2. The firearm of claim 1, wherein the exhaust port includes a fluid passageway from the face to a radial sidewall of the piston.

3. The firearm of claim 2, wherein the gas piston includes a plurality of passageways.

4. The firearm of claim 1, wherein an operating rod connects the piston to the bolt carrier.

5. The firearm of claim 4, wherein the piston and operating rod are rigidly separably connected.

6. The firearm of claim 1, wherein the connection between the piston and the bolt carrier includes a separable lugs and socket engagement to transfer longitudinal forces.

7. The firearm of claim 1, wherein the gas pressure is exhausted before substantial displacement of the piston to cycle the action.

8. An external piston gas-operated firearm with adjustable gas flow, comprising:

a gas piston operably connected to a bolt carrier;

a gas block having an internal cylinder configured to receive a head portion of the gas piston, the cylinder operably connected to a barrel bore to allow propellant gas pressure to bear against a face of the piston head portion; and wherein the gas piston includes at least one axially selectively positionable exhaust port such that in a first axial orientation no gas is vented through the exhaust port and in a second axial orientation a portion of the gas pressure is exhausted in conjunction with displacement of the piston to cycle the action, wherein the gas block includes at least one channel providing fluid connection to atmosphere outside the gas block.

9. The firearm of claim 8, wherein the gas piston includes a plurality of exhaust ports and the gas block includes a plurality of channels providing fluid connection to atmosphere outside the gas block.

10. The firearm of claim 8, wherein the exhaust port includes a fluid passageway from the face to a radial sidewall of the piston and the channel is operably aligned in the cylinder with the fluid passageway.

11. The firearm of claim 8, wherein the channel vents forwardly from the gas block.

12. An external piston gas-operated firearm with adjustable gas flow, comprising:

a gas piston operably connected to a bolt carrier;

a gas block having an internal cylinder configured to receive a head portion of the gas piston, the cylinder operably connected to a barrel bore to allow propellant gas pressure to bear against a face of the piston head portion; and wherein the gas piston includes at least one axially selectively positionable exhaust port such that in a first axial orientation no gas is vented through the exhaust port and in a second axial orientation a portion of the gas pressure is exhausted in conjunction with displacement of the piston to cycle the action, wherein the connection between the piston and the bolt carrier includes indicia indicating the selected position of the piston exhaust port.

13. An external piston gas-operated firearm with adjustable gas flow, comprising:

a gas piston operably connected to a bolt carrier;

a gas block having an internal cylinder configured to receive a head portion of the gas piston, the cylinder operably connected to a barrel bore to allow propellant gas pressure to bear against a face of the piston head portion; and wherein the gas piston includes at least one axially selectively positionable exhaust port such that in a first axial orientation no gas is vented through the exhaust port and in a second axial orientation a portion of the gas pressure is exhausted in conjunction with displacement of the piston to cycle the action, wherein an operating rod connects the piston to the bolt carrier, wherein the operating rod includes indicia indicating the selected position of the piston exhaust port.

14. The firearm of claim 13, wherein the indicia is positioned to be visible externally of the firearm.

15. The firearm of claim 14, wherein the indicia is positioned to be aligned with an opening in a handguard of the firearm.

16. The firearm of claim 15, wherein the handguard includes marking that corresponds to indicia on the operating rod.

17. An external piston gas-operated firearm with adjustable gas flow, comprising:

a gas piston operably connected to a bolt carrier;

a gas block having an internal cylinder configured to receive a head portion of the gas piston, the cylinder operably connected to a barrel bore to allow propellant gas pressure to bear against a face of the piston head portion; and wherein the gas piston includes at least one axially selectively positionable exhaust port such that in a first axial orientation no gas is vented through the exhaust port and in a second axial orientation a portion of the gas pressure is exhausted in conjunction with displacement of the piston to cycle the action, wherein the connection between the piston and the bolt carrier include a separable lugs and socket engagement to transfer longitudinal forces, wherein the socket is in the bolt carrier and the piston includes separate lugs corresponding with the piston's selectable positions.

* * * * *